US005855757A

United States Patent [19]

Sivilotti

[11] Patent Number: 5,855,757

[45] Date of Patent: Jan. 5, 1999

[54] METHOD AND APPARATUS FOR ELECTROLYSING LIGHT METALS

[76] Inventor: Olivo Sivilotti, 26 Stormont Avenue, Kingston, Ontario, Canada, K7M 1P1

[21] Appl. No.: 785,295

[22] Filed: Jan. 21, 1997

[51] Int. Cl.[6] ..... C25C 3/00; C25C 7/00; C25C 7/06

[52] U.S. Cl. ..... 205/367; 204/245; 204/246; 204/247; 204/244; 204/241

[58] Field of Search ..... 204/245 R–247, 204/241; 205/367

[56] References Cited

U.S. PATENT DOCUMENTS

| | | | |
|---|---|---|---|
| 1,501,756 | 7/1924 | Downs . | |
| 2,876,181 | 3/1959 | Wood, Jr. . | |
| 2,944,950 | 7/1960 | Hayes . | |
| 3,085,969 | 4/1963 | Motock . | |
| 3,335,076 | 8/1967 | Burkhardt . | |
| 3,396,094 | 8/1968 | Sivilotti et al. . | |
| 3,418,223 | 12/1968 | Love . | |
| 3,502,553 | 3/1970 | Gruber . | |
| 3,893,899 | 7/1975 | Dell et al. | 204/244 |
| 3,962,064 | 6/1976 | Brut et al. . | |
| 4,055,474 | 10/1977 | Sivilotti . | |
| 4,110,178 | 8/1978 | Lacamera et al. | 204/244 X |
| 4,420,381 | 12/1983 | Sivilotti et al. . | |
| 4,481,085 | 11/1984 | Ishizuka | 204/244 X |
| 4,514,269 | 4/1985 | Sivilotti . | |
| 4,518,475 | 5/1985 | Sivilotti | 204/247 |
| 4,518,745 | 5/1985 | Engelhardt et al. . | |
| 4,604,177 | 8/1986 | Sivilotti . | |
| 4,617,098 | 10/1986 | Verdier et al. . | |
| 4,724,055 | 2/1988 | Le Roux et al. . | |
| 4,740,279 | 4/1988 | Muller et al. . | |
| 4,744,876 | 5/1988 | Bernard et al. . | |
| 4,749,463 | 6/1988 | Holmen | 204/241 |
| 4,865,701 | 9/1989 | Beck et al. | 204/241 X |
| 4,960,501 | 10/1990 | Sivilotti . | |
| 5,417,815 | 5/1995 | Robinson et al. . | |

OTHER PUBLICATIONS

Sivilotti O.G., "Operating Performance of the Alcan Multipolar Magnesium Cell, Light Metals", 117th AIME Annual Meeting, Phoenix, 1988 (No Month).

*Primary Examiner*—Donald R. Valentine
*Attorney, Agent, or Firm*—Dickinson Wright PLLC

[57] ABSTRACT

The present invention provides a new and useful process for the production of a molten metal by electrolysis in an electrolytic cell having an electrolysis compartment, a metal recovery compartment, and a partition separating upper parts of said compartments, said process comprising: electrolysing in said electrolysis compartment an electrolyte containing a fused salt of said metal said electrolyte being of greater density than said metal; continuously withdrawing the product metal mixed with said electrolyte in a stream from said electrolysis compartment to a top part of said metal recovery compartment; allowing said metal to form in said metal recovery compartment a pad floating on said electrolyte; maintaining said pad out of contact with said partition; and recovering said pad.

25 Claims, 5 Drawing Sheets

METHOD AND APPARATUS FOR ELECTROLYSING LIGHT METALS

FIELD OF THE INVENTION

This invention relates to improved processes and apparatus for the production of molten metals by electrolysis of their fused salts where the metal is lighter than the electrolyte. More particularly, the invention relates to improved method and apparatus to collect molten metals such as lithium, magnesium, or sodium in electrolytic cells of monopolar and multipolar design

BACKGROUND OF THE INVENTION

All electrolytic cells that are used to commercially produce lithium, magnesium or sodium utilize an electrolysis compartment where the electrolysis gas is collected and a metal recovery compartment in which the metal collects and is stored between tappings. Between the two compartments is a partition. As a common feature, this partition is usually immersed deep in the electrolyte to effect good separation of the electrolysis gas and long storage of the metal produced. This partition, sometimes called a curtain wall or semi-wall, is a critical component of the cell due to the reactivity of the gas and/or the metal and the consequent need to maintain their separation, but it is usually one of the components that limit the operating life of a cell due to wear and cracking. The chemical wear of the curtain wall in contact with the metal may be responsible for some loss of product metal purity, and cracks in the curtain wall result in leaks of metal and air into the electrolysis compartment with consequent oxidation of the graphite anodes and back reaction of the metal with the electrolysis gas.

PRIOR ART

U.S. Pat. No. 1,501,756, issued 15 Jul. 1924 to Downs, describes a process commercially used to produce sodium from sodium chloride. The process uses for the collection of the molten sodium an upper reservoir which is separate from the electrolysis cell itself.

U.S. Pat. No. 3,396,094, issued 6 Aug. 1968 to Sivilotti et al., describes an electrolytic magnesium cell that is provided with a metal collecting reservoir, located in the metal compartment and almost wholly submersed in the electrolyte. The reservoir consists of an inverted box of steel along the partition above openings through the curtain wall. The reservoir is open along its bottom to receive the metal that comes through the openings through the curtain wall. This metal collection arrangement was superior to the prior art, where the metal was allowed to float freely on the surface of the electrolyte. It allowed the cell to operate with the electrolyte temperature near the melting point of the metal, which resulted in substantial improvement of the current efficiency of the cell. The metal had to be maintained molten to be tapped out of the cell by conventional siphon means, and the fact that the metal was maintained under the surface of the electrolyte equalized the two temperatures without need of supplementary heating means. Relatively large quantities of metal were collected and the need for undue frequency of tapping was avoided.

It was subsequently found that oxidation of the residual floating metal that escaped collection into the reservoir and hydrolysis of the electrolyte were detrimental to the operation of the cell. Sludge formation, short cell life and upsets in current efficiency were still experienced.

A fully enclosed cell provided with an insulating cover, with an inert gas blanket and with internal temperature control means, was developed as described in U.S. Pat. No. 4,420,381. The heat exchanger had to be well insulated where it passed through the floating metal pad in order to avoid premature freezing of the metal.

The design of U.S. Pat. No. 4,420,381 was an improvement over the previous art and has been used with other more recent improvements in cell design. These improvements are related to the use of new electrode geometries, in particular those of multipolar design, that substantially increase cell productivity and decrease unit energy consumption. These improved cells are described in U.S. Pat. Nos. 4,055,474; 4,514,269; 4,518,475; 4,604,177 and 4,960,501, which are incorporated herein by reference. These cells require an even tighter control of the temperature and of the oxidation reactions. Also, they are producing at a high rate so that the volume of metal to be stored in the metal compartment between tappings is very large. Additionally, for good current efficiency, the multipolar cells require an almost constant level in the electrolysis compartment. This can be obtained by feeding the cells continuously in response to level sensing means, or by regulating the supply of inert gas to and from a submersed open-bottom reservoir, to compensate for liquid volume changes when feeding and tapping are carried out intermittently.

In the cell described in U.S. Pat. No. 4,518,475 the electrolyte circulation towards the metal compartment occurs sideways in the planes of the inter-electrode spaces and over a weir, located inside the electrolysis compartment, downstream from the electrodes and upstream from the curtain wall. The electrolyte/metal mixture flows over the weir so that the level above the electrodes remains almost constant. However, the turbulence downstream from the weir entrains residual gas within the electrolyte flowing into the metal compartment. Also, the turbulence hinders coalescence of the metal that would help its rising towards the floating metal pad.

Coalescence could be a significant factor to improve the current efficiency of multipolar cells, as it is believed that droplets which are smaller than a critical size and are recirculated in the electrolysis compartment are consumed by back reactions in the inter-electrode spaces (see Sivilotti O. G., *Operating Performance of the Alcan Multipolar Magnesium Cell, Light Metals,* 117th AIME Annual Meeting, Phoenix, 1988). The critical size of the metal droplets depends on the degree of turbulence and on the path of the circulating electrolyte. Therefore, the geometry of the metal compartment where the metal separates by upwards settling is very important to obtain high current efficiency.

U.S. Pat. No. 5,417,815, issued 23 May 1995 to Robinson et al., describes the prior art for apparatus and methods to produce lithium metal from molten mixtures of lithium chloride and other metal chlorides. The patent describes a liquid metal skimmer based on the use of mechanical propellers in a draft tube. Devices based on mechanical moving parts are difficult to maintain in continuous reliable operation because of the high-temperature molten-salt environment.

While satisfactory operation has been obtained with cells of the prior art, the present invention is designed to obtain significant improvements in such cells and in their method of operation. The main objectives are a better current efficiency and improved yield and recovery of purer metals, as well as greater convenience in the collection and removal of the metal. Cheaper construction and longer operating life result in lower capital costs and lower maintenance expenses.

SUMMARY OF THE INVENTION

It is an object of the present invention to provide a process to electrolytically produce at high current efficiency lithium, magnesium, sodium and other molten metal products that are lighter than the electrolyte.

Another object of the invention is to provide a process to electrolytically produce reactive light metals of high purity.

A further object of the invention is to provide a method for efficiently separating a light metal from an electrolyte stream and for facilitating its tapping at infrequent intervals.

A still further objective of the invention is to provide an electrolytic cell of long life and of cost effective construction for the production of metals lighter than the electrolyte.

Thus in one embodiment the invention provides a process for the production of a molten metal by electrolysis in an electrolytic cell comprising a process for the production of a molten metal by electrolysis in an electrolytic cell having an electrolysis section and, continuous with said electrolysis section a metal recovery section, said process comprising: electrolysing in said electrolysis section of said cell an electrolyte containing a fused salt of said metal to produce said metal, said electrolyte having a greater density than said metal; causing said metal and additional said electrolyte to circulate continuously from said electrolysis section to said recovery section; continuously separating said metal from said electrolyte in said recovery section; causing said metal to circulate toward a part of said recovery section remote from said electrolysis section; conveying said metal from said recovery section to said submerged reservoir; and periodically recovering said metal from said reservoir.

In a further embodiment the invention provides an electrolytic cell comprising an electrolytic cell comprising an electrolysis section; a metal recovery section continuous with said electrolysis section; a submerged reservoir for storing a product metal; and means for conveying a product of electrolysis from said metal recovery section to said reservoir.

BRIEF DESCRIPTION OF THE DRAWINGS

The advantages of the invention will become apparent upon reading the following detailed description and upon referring to the drawings in which.

Figure 1:
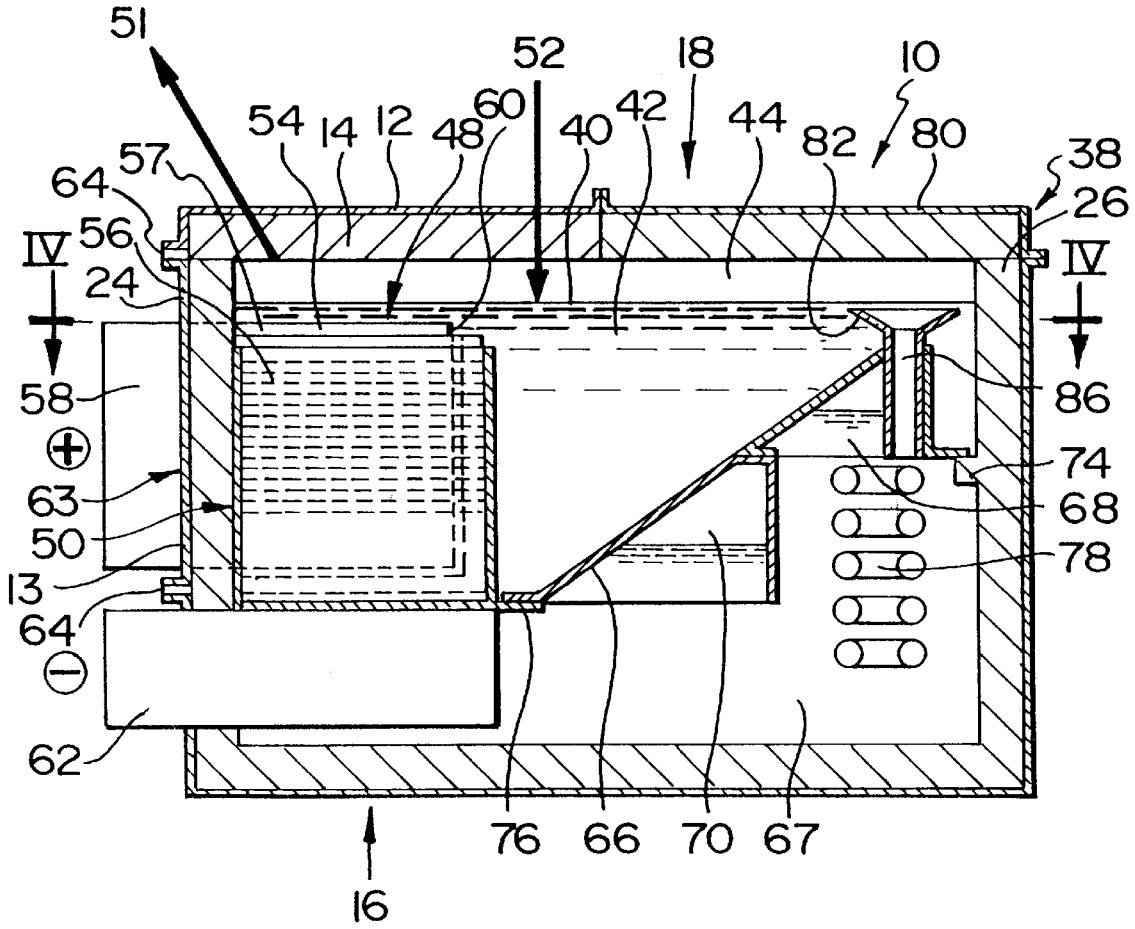
FIG. 1 is a vertical cross-section front to back through a cell according to the invention.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

As is evident in the prior art, and in any event to those skilled in the art, the invention is in the context of electrolytic cells which are divided into electrolysis and metal recovery compartments which have conventionally been separated by a partition or curtain wall. When the cell is in operation a natural circulation is set up brought about by the liberation of gas in inter-electrode spaces. As the gas rises, it functions as a pump to set up circulation within the cell. Various means have been used to direct the circulating stream along the upper part of the cell from the electrolysis compartment to a metal recovery compartment and hence downward to the lower part of the metal recovery compartment and back to the lower part of the electrolysis compartment under the electrodes. In the metal recovery compartment a floating metal pad is formed and is tapped, generally on an intermittent basis. At an appropriate point in the cycle the cell is fed to enrich the electrolyte.

Two general criteria are required to obtain current efficiencies that are as high as, or close to, those obtainable in electrolytic cells that collect the metal at the cathode and keep it separate from the electrolysis gas (as for example U.S. Pat. No. 3,396,094). First, the metal droplets that are released in the inter-electrode space and are entrained in the circulating electrolyte must spend the shortest possible time in the inter-electrode space; and, second, the droplets must separate from the electrolyte into a metal pad regardless of their small size. To meet the first criterion the electrolyte is made to circulate as fast as possible in the inter-electrode space and to meet the second criterion, notwithstanding the fast electrolyte flow, means are provided to obtain coalescence and separation of metal droplets before the electrolyte is returned to the bottom of the inter-electrode space.

Contrary to earlier belief, it has now been discovered that coalesced metal droplets (and even a small metal pad) floating on the surface of the electrolysis compartment do not contribute significantly to loss of current efficiency, as a film of electrolyte coats the surface of the metal and prevents the direct contact between the metal and the electrolysis gas, when good wetting conditions between metal and electrolyte are maintained.

To meet other objectives of the invention, the separated metal must be maintained out of contact with the refractory walls as much as possible to prevent reaction with the latter and consequent contamination of the metal. This is to be obtained notwithstanding the desirability, for efficient operation, of tapping as infrequently as possible the metal produced.

The fact that the reaction between the refractory walls and the metal is prevented and the fact that the cell is sealed to eliminate metal oxidation and electrolyte hydrolysis are further requirements to obtain high current efficiency, high yields and long operating life.

Figure 2:
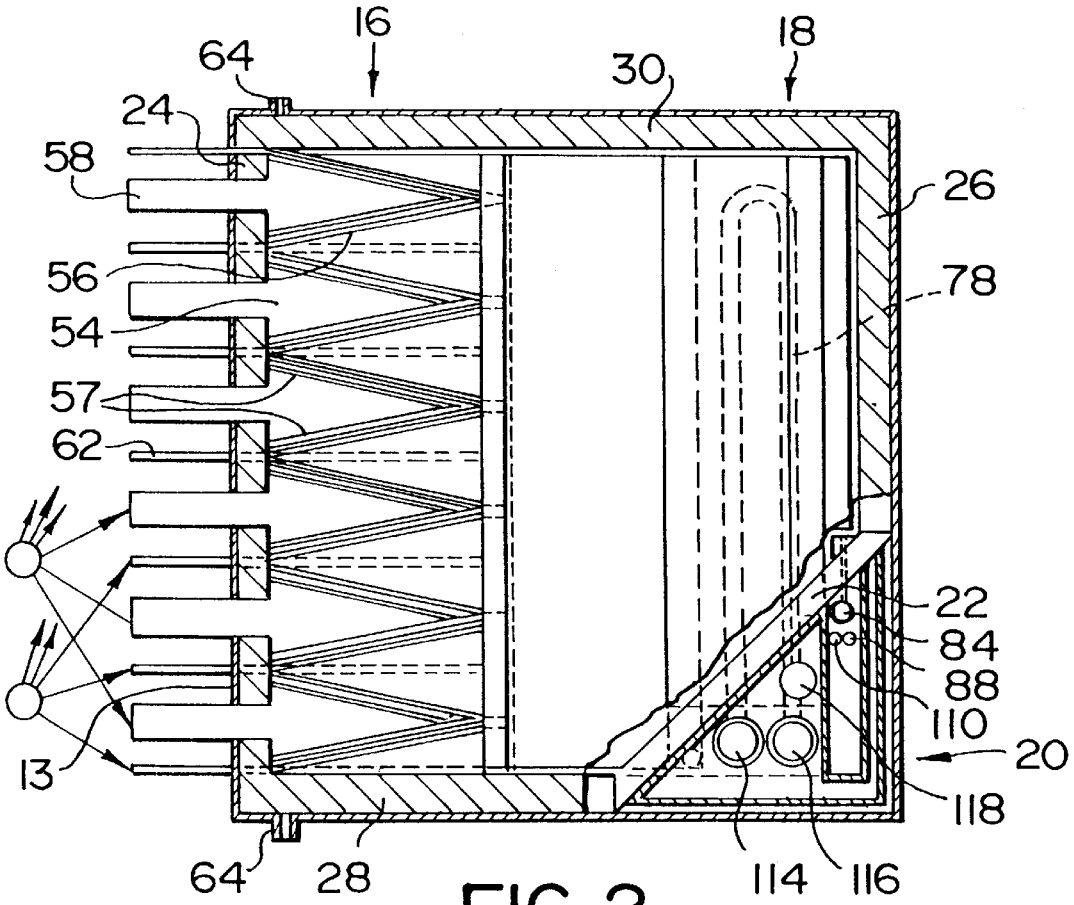
FIG. 2 is a plan view partly in section of the cell of FIG. 1.
Figure 3:
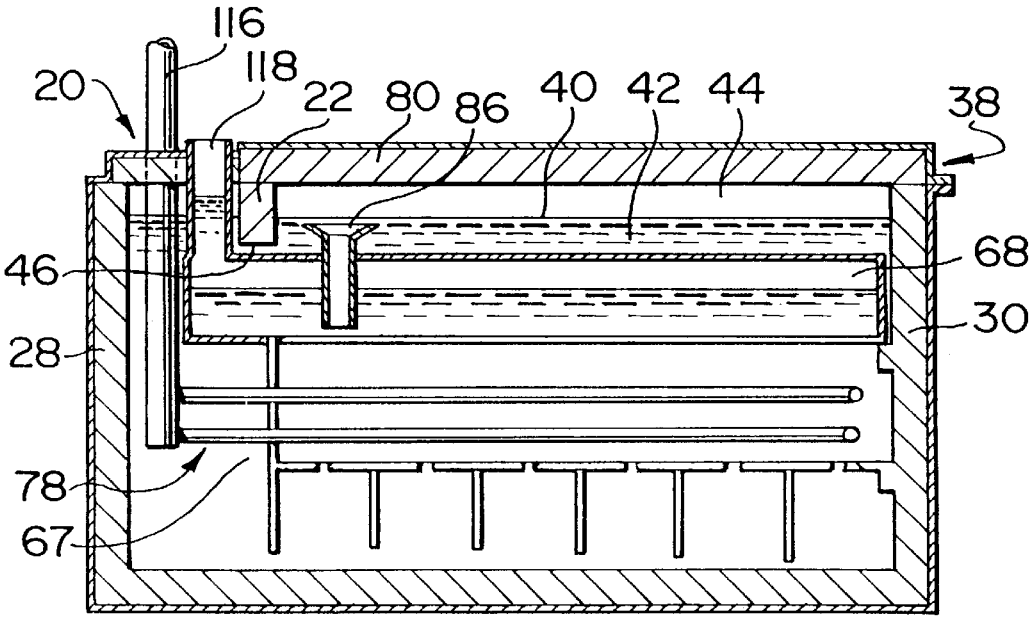
FIG. 3 is a vertical transverse cross-section of the cell of FIG. 1.

In reference to FIGS. 1 to 3, The apparatus illustrated is an electrolytic cell 10 having a structural steel casing 12 lined with a layer of insulating and refractory material 14 suitable to contain a molten salt electrolyte. The cell 10 is divided into an electrolysis section 16, a metal recovery section 18, and a services section 20, the last separated from the other sections by a semi-wall, partition, or curtain wall 22.

Cell 10 comprises back wall 24, front wall 26 and side walls 28 and 30. In one preferred configuration the partition wall 22 extends diagonally across the front corner of cell 10 from front wall 26 to side wall 28 (or 30).

In a further and most preferred configuration the services section 20 is external to cell 10 and is defined by a set of side walls 32, 34 and 36. In this configuration the partition wall 22 comprises a part of side wall 28 of cell 10.

The cell 10 is provided with top 38 which may be in sections for convenience of handling and which seals the cell, including the services section 20, when the cell is in operation. The partition wall 22 is preferably integral with a section of top 38 and extends downwardly a short distance below surface 40 of electrolyte 42 to thereby seal services section 20 against entry into that section of electrolysis gas liberated into space 44 between surface 40 of electrolyte 42 and top 38 of cell 10.

Below surface 40 of electrolyte 42 and below the bottom 46 of partition wall 22, the services section 20 is open to electrolyte 42 in cell 10.

The electrolysis gas disengages from the electrolyte at top 48 of the electrodes 50 and is collected under the refractory-lined cover 38. The gas is withdrawn under slightly negative pressure through a gas duct schematically shown by the arrow 51.

The arrow 52 indicates the location of feed entry into the cell 10 through refractory-lined lid 38 when the cell is to receive solid feed.

In the preferred arrangement, the anodes 54 and cathodes 56 are disposed along the back wall 24 of cell 10 and provide facing surfaces for the electrolysis process. One or more bipolar electrodes 57 is (are) interposed between anode and cathode when a multipolar structure is used. The gas generated on the anodic surfaces provides the pumping action to the electrolyte as the gas rises in the inter-electrode spaces. The electrolyte carries entrained metal droplets with it.

Figure 4:
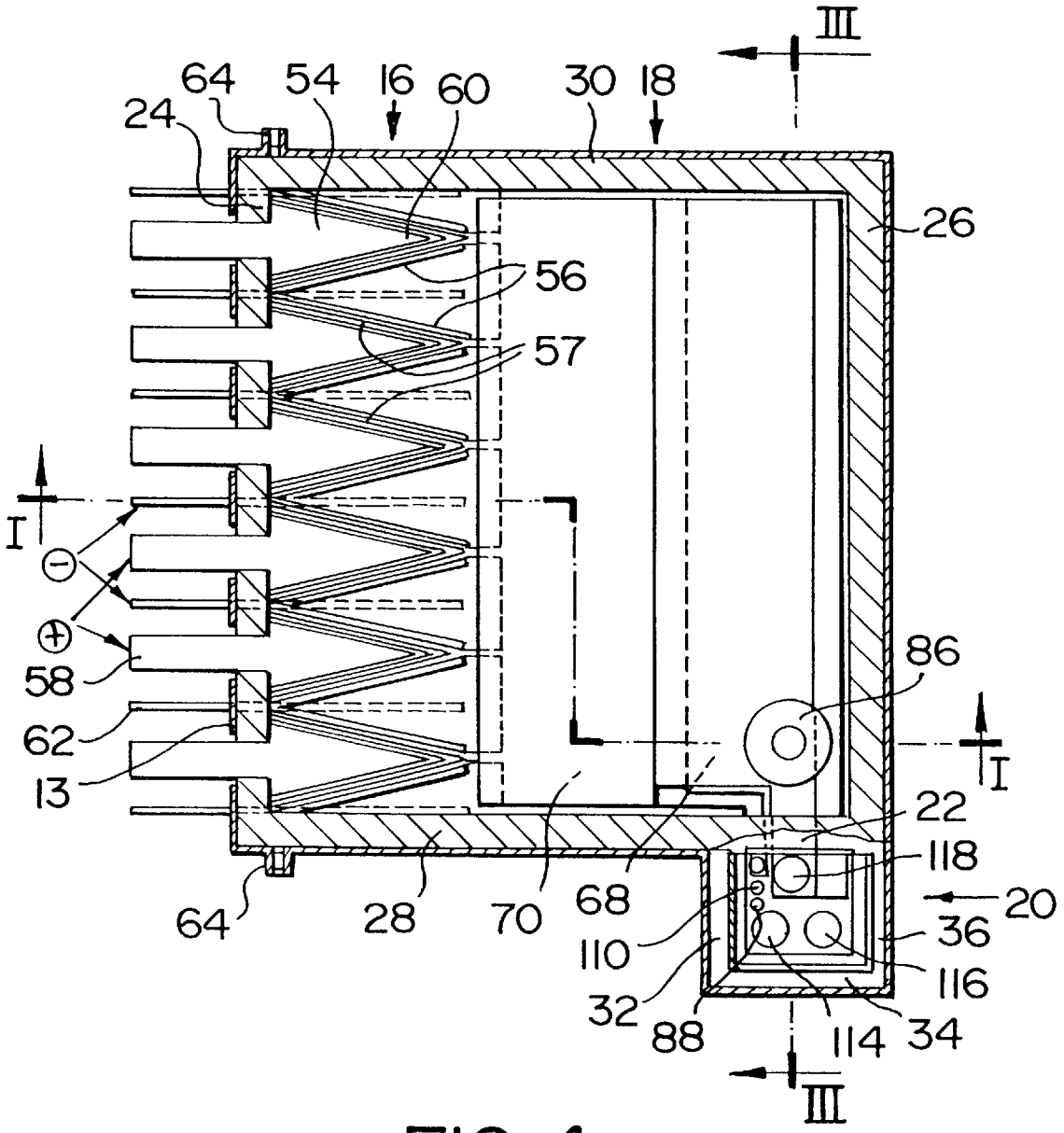
FIG. 4 is a plan view partly in section of another embodiment of the cell of FIG. 1.

As shown in the horizontal views of FIG. 2 and 4, the anodes are preferably wedge shaped, with decreasing cross-section outwardly from back wall 24, thus pointing toward the front of the cell, while the cathodes are opposite. The anodes are preferably though not necessarily pointed.

This geometry is more advantageous when the anode leads 58 are mounted through the back wall 24 of cell 10, as the current flows in the body of the anode at uniform current density from the root of the anode to the pointed end 60. The cathode leads 62 are also mounted through the back wall 24 of cell 10, preferably through the bottom part of wall 24, in order to reduce the danger of short-circuits through the electrolyte-wetted refractory lining. The lining may be rapidly destroyed by such event. Alternatively, to further reduce this danger, the cathode leads may be mounted through the bottom of the cell 10, but the connection to the cathode busbar will be more difficult. For electrical insulation reasons, both the anode and the cathode leads 58 and 62 are isolated from the cell casing. As an additional precaution, part 63 of the casing 12 that surrounds the anode leads 58 is electrically insulated from the rest of casing 12 by spacers 64.

The electrolyte/metal mixture flows along the cathode 56 toward the front of cell 10. The wedge-like geometry of the cathode is particularly useful in providing to the electrolyte a linearly increasing cross-sectional area that matches the increasing volume of the electrolyte discharged along the top of the cathode. In this way, after the discharge, the turbulence is minimized and the metal droplets entrained in the electrolyte start to coalesce immediately. The space between the non-working faces of the cathode may be filled with a set of metallic nets or other conventional means to help the metal coalescence.

Contrary to earlier cells, it must be understood that the electrolyte flow velocity is slowed while still in the electrolysis section, by reason of cell geometry, so coalescence, as indicated, begins in the electrolysis section.

An important aspect of the invention is the continuity between the metal recovery section 18 and the electrolysis section 16, the former extending to the front wall 36 of cell 10. Leaving the electrolysis section and in the metal recovery section 18, the electrolyte flows at very low velocity, so that the time for the metal droplets to separate from the electrolyte is maximized.

A bottom wall 66 of metal recovery section 18 forms the sloping roofs of two open-bottom reservoirs 68 and 70, which are set in cascading and sealing sequence along the return flow path of the electrolyte in the lower part 67 of cell 10. Reservoir 68 provides storage capacity for the metal produced between tapping cycles; and reservoir 70, for the inert gas required to compensate for volume changes during intermittent tapping and feeding operations.

Reservoir 68 is an open-bottom steel box that runs along the front wall 26 preferably in sealing abutment with the side walls 28 and 30 and front wall 26. It is supported on a ledge 74 along wall 26 and on similar ledges on the side walls 28 and 30 of the cell. Reservoir 70 is similarly supported in sealing abutment on the front end of the cathodes at 76 and on ledges on the side walls 28 and 30. Reservoir 68 is sufficiently heavy to stand firm on its supports, while reservoir 70 should have adequate ballast to keep it in place when full of inert gas.

Reservoirs 68 and 70, as well as heat exchanger 78, are located below the curtain wall 22 and preferably extend into services section 20. When those components must be removed for maintenance, curtain wall 22 must also be removed. Therefore curtain wall 22 is preferably attached to the front section 80 of the cell lid, as noted above. To minimize this problem, more efficient heat exchangers can be used, based on thermosyphon and/or heat pipe designs of simple vertical or gently curved pipe geometry which can be extracted from cell 10 through services section 20.

FIG. 4 shows a transverse curtain wall, while FIG. 2 shows a diagonal geometry. The transverse curtain wall is preferred as the width is smaller and can be built of a single refractory block that can be handled independently. However, in either case, the front wall 26 of the cell 10 remains straight, and, preferably, a series of cells are operated from a platform running along the front of the cells.

The means for conveying metal into reservoir 68 preferably has entry funnel 82 at surface 40 of the electrolyte 42 in the metal recovery section, where the metal collects naturally. There are two preferred means of transfer; an active pump 84 or a skimmer-tube 86. A selection is made depending on the relative density of the metal and the pressure head available. A large hydraulic head is required to force a light metal down into a skimmer-tube, and, therefore, in lithium cells of monopolar design, it is best to use a transfer pump. The opposite is true for magnesium cells of multipolar design where the gas-lift action is strong and the relative metal density is only about 10%. In this case the electrolyte flow through the skimmer-tube could be only a fraction of the total flow, and leaks around the reservoirs can be tolerated.

Figure 5:
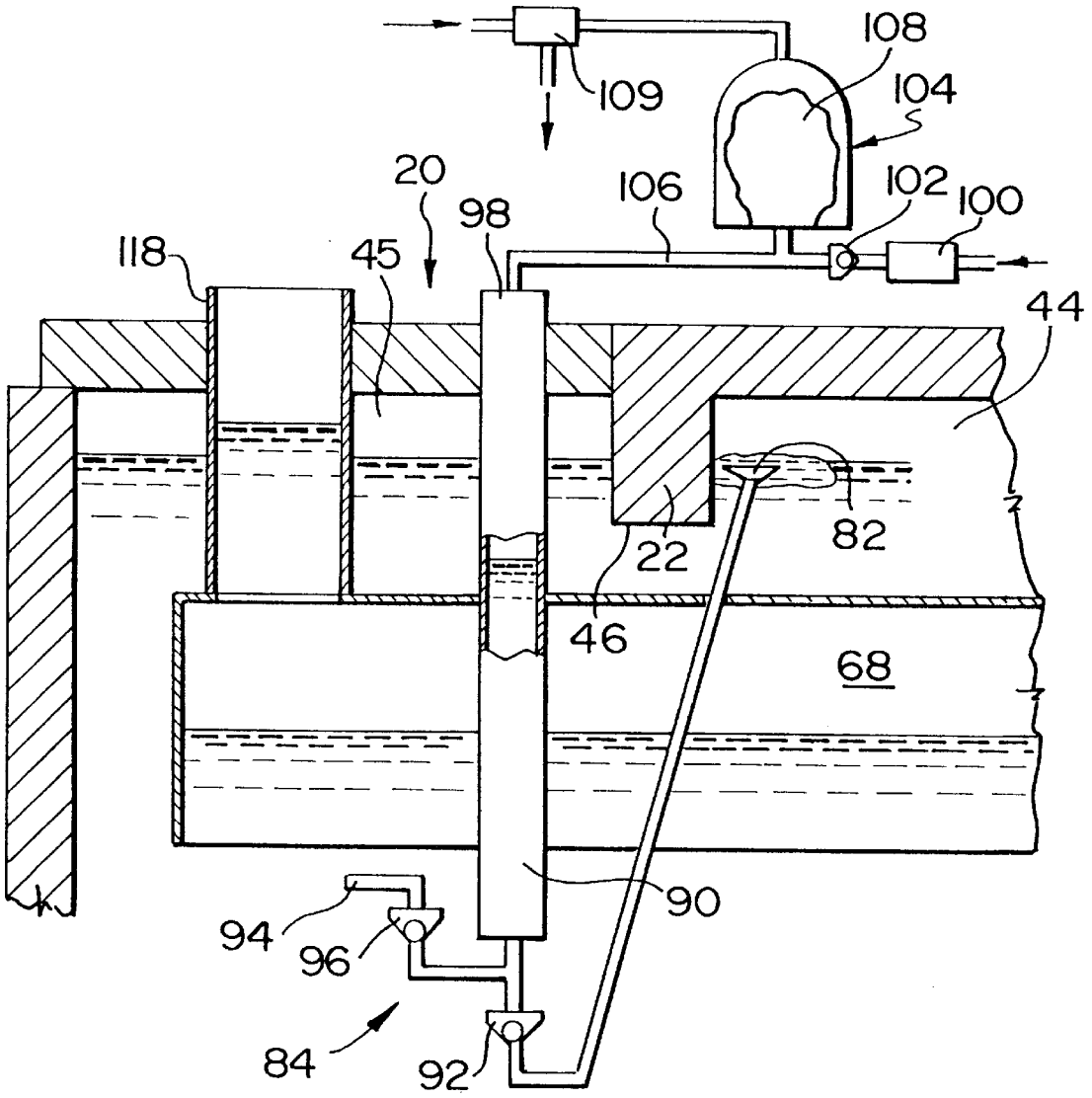
FIG. 5 is a schematic cross-section of a transfer pump in position for use in a cell according to the invention.
Figure 6:
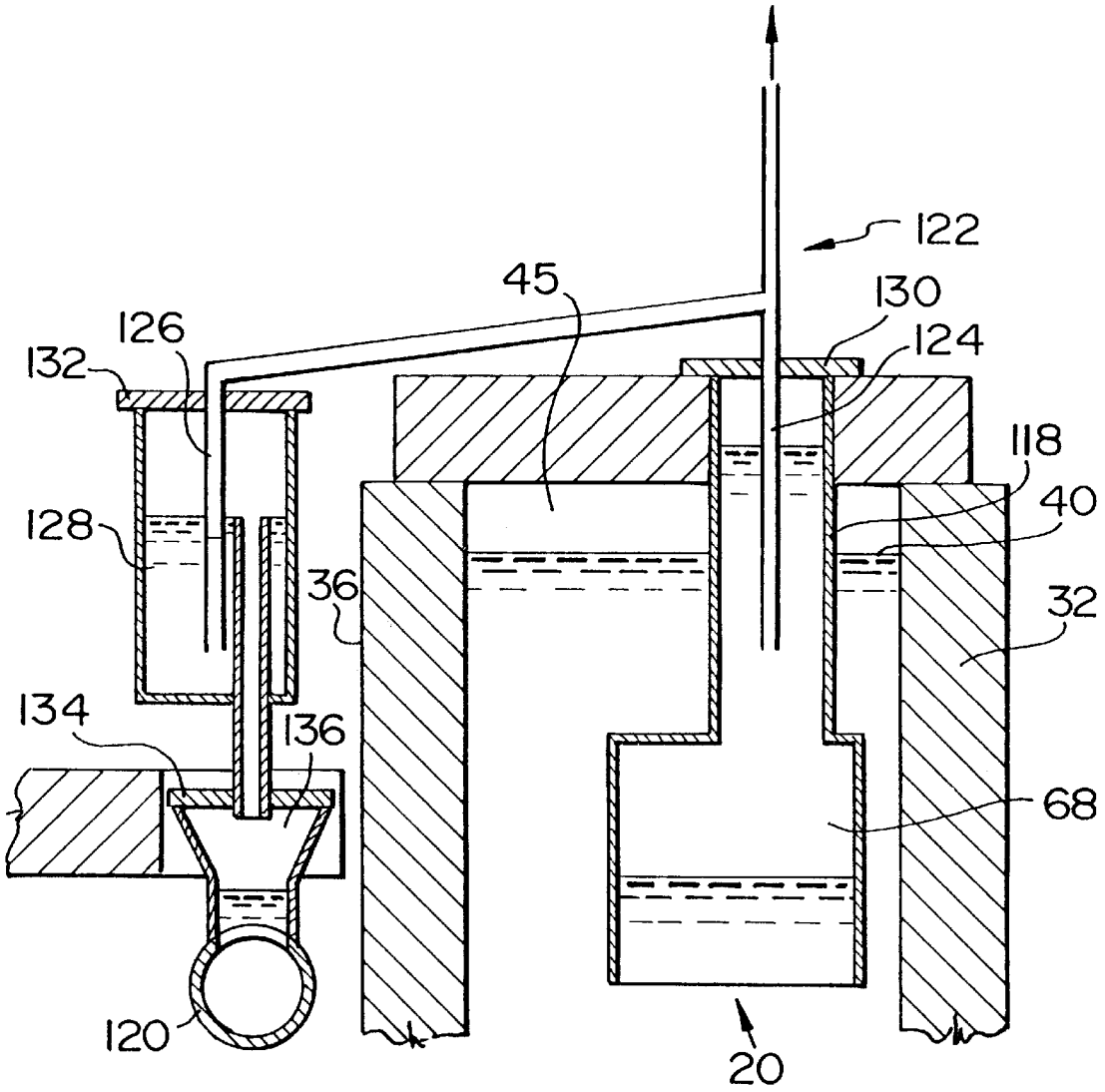
FIG. 6 is a schematic cross-section through a part of a cell and a syphon arrangement for use with the cells of the invention.

Mathematical and/or physical modelling techniques are used to design the skimmer-tube 86. A good reference is a paper by R. Sankaranarayanan and R. I. L. Guthrie entitled: *Vortex Suppression Device Improves Steel Cleanness,* 1995-14th PTD Conference Proceedings of the Iron and Steel Society. A vortex phenomenon (that is stated to enhance entrapment of the floating slag) may be encouraged in the present invention by locating skimmer-tube 86 away from the centre of symmetry of the cell. The level of electrolyte over the entry funnel 82 and the hydraulic pressure drop through the tube itself is controlled by using level sensing means 88 and feeding or bleeding inert gas into and out of reservoir 70. Level fluctuations of the order of about one centimetre are acceptable for satisfactory performance.

Where a pump is required or desired, conventional rotary pumps may be used. However, a transfer pump design that meets the tough environmental conditions of a fused salt electrolytic cell is described schematically in FIG. 5. The body of the pump is a vertical tube 90 partially immersed in the electrolyte and located in the services section 20 out of contact with the electrolysis gas. The bottom of the tube is connected via a non-return valve 92 to the entry funnel 82 and to a bottom discharge nozzle 94, via another non-return valve 96. The non-return valves cause the flow To occur only in the direction from the entry funnel 82 and to the bottom nozzle 94 respectively. The top 98 of the tube 90 is connected to an inert gas supply via a pressure reducer 100 and a non-return valve 102. Between the non-return valve 102 and tube 90, a pneumatic accumulator 104 is connected to the inert gas line 106. The bladder 108 of accumulator 104 expands or contracts, depending on whether compressed air is fed into or bled out of the accumulator via three-way valve 109. By periodically switching the three-way valve with solenoids, inert gas is caused to be moved, in known volumes, in and out of the tube 90, causing intermittent flow of liquid in alternating directions through its bottom connection. Thereby the volume is known of fluid transferred from the surface of the electrolyte in the metal recovery section to the region below the metal collecting reservoir 68. By selecting a frequency of operation that matches the volume of metal production, the size of the metal pad that forms at the entry funnel between pump cycles is maintained at an acceptable level. Preferably, the rate of pumping is maintained higher than the rate of metal production and the fluid flow in the transfer pump is a mixture of metal and electrolyte, with the latter making up for the differences.

As well, a parallel path is provided for electrolyte circulation, and this may follow several paths. For example, openings may be provided in the bottom wall 66 of metal recovery section 20, circulation may occur through section 20 under wall 22, etc.

The transfer pump 84 is mounted on the refractory and insulating lid 38 of the services section 20 in such a way that it can be installed and removed for maintenance reasons without removal of the lid 38 or of the curtain wall 22. All the equipment on lid 38 is installed by means of gas-tight flanges so that during operation a slight positive pressure of inert gas can be maintained in space 45.

In order to access cell 10 without exposure to the electrolysis gas in space 44, various entry points are provided into services section 20. Thus, temperature and level sensing means 110 and 88, and heat exchanger inlet and outlet 114 and 116 are preferably located in services section 20. A tapping spout 118 is also located in services section 20 and extends into reservoir 68 to provide access to the reservoir for tapping the product metal. Where a transfer pump is utilized, as discussed above, as a means of conveying product from the metal recovery section to reservoir 68, the pump is also preferably located in services section 20.

In commercial operation, cells of the present invention will be used as part of a bank of multiple such cells. The molten metal can be tapped from reservoir 68 by conventional means, such as syphons attached to vacuum ladles moved to and from the cell by truck on the operating platform conventionally present on the front of the bank of cells. Alternatively, the ladles may be moved by mobile overhead crane.

However, it has been found very advantageous to provide each cell 10 in a bank of cells with metal tapping means connected directly to a hot metal piping system leading from the cells to the cast-house. Preferably a pipeline 120 is located along the front of a series of cells below the operating platform. Pipeline 120 is preferably thermally insulated and is made up of thermostatically controlled modules in a closed loop network in such a way as to secure continuous operation of the cells even when a pipe module must be isolated from the pipeline loop and removed for maintenance.

In order to avoid short-circuiting between cells, the tapping must be performed on a cell by cell basis. When a cell is discharging metal into the pipeline 120 during tapping, a direct electrical connection is set up by the molten metal between the cell and the pipeline so that the pipeline rises to the potential of the cell being tapped, while the rest of the cells are electrically insulated from the pipeline.

The tapping means in each cell 10 preferably consists of a syphon pipe 122 with a leg 124 immersed in the tapping spout 118 just below the level of the electrolyte. A second leg 126 is immersed in a downstream trap 128, the liquid level in which is just above the level of electrolyte in cell 10. The lower metal density causes the metal level in the tapping spout 118 to be higher than the level in the trap and thus enables the syphon, when primed, to discharge metal from cell 10 to pipeline 120.

Preferably, when the syphon is not in use, it is connected to an inert gas supply which maintains a slight positive pressure in the syphon to avoid ingress of air.

Similarly, electrically and thermally insulating lids 130, 132 and 134 are provided to seal the top of the tapping spout 118, the trap 128 and the entry 136 to the pipeline 120. The spaces below the lids are at all times supplied with inert gas at slightly positive pressure to avoid oxidation of the metal.

To initiate a tapping procedure, the application of vacuum at the top of the syphon causes the metal to move up leg 124 of syphon 122 to the top of the leg 124 and hence into leg 126 to initiate flow. The level in the downstream trap in the syphon is located just above the electrolyte level, so that the flow is maintained through the syphon only if there is metal in the submerged reservoir 68. When the reservoir is empty of metal, the flow will naturally stop, even if the syphon is still primed by the vacuum line. This system preferably includes a pre-set time of operation of the syphon, after which the vacuum line is switched off and the inert gas line activated.

In good operational practice the syphon is preferably pre-heated to operating temperature, prior to initiating the tapping sequence.

It is apparent that there has been provided in accordance with the invention a METHOD AND APPARATUS FOR ELECTROLYSING LIGHT METALS that fully satisfies the objects, aims and advantages set forth above. While the invention has been described in conjunction with (a) specific embodiments(s) thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows: what I claim as my invention:

1. A process for the production of a molten metal by electrolysis in an electrolytic cell having an electrolysis section containing a series of anodes and cathodes in facing relationship, a metal recovery section continuous with said electrolysis section, and a submerged reservoir, said process comprising:

electrolysing in said electrolysis section of said cell an electrolyte containing a fused salt of said metal to produce said metal, said electrolyte having a greater density than said metal;

allowing said metal and additional said electrolyte to circulate at high velocity upward in inter-electrode spaces in said electrolysis section;

causing said metal and said electrolyte to circulate at low velocity between non-working faces of said cathodes and continuously to said recovery section;

continuously separating said metal from said electrolyte in said electrolysis and said recovery sections;

causing said metal to circulate toward a part of said recovery section remote from said electrolysis section;

conveying said metal from said recovery section to said submerged reservoir; and periodically recovering said metal from said reservoir.

2. A process for the production of a molten metal by electrolysis in an electrolytic cell having an electrolysis section, a metal recovery section continuous with said electrolysis section, and a submerged reservoir, said process comprising:

electrolysing in said electrolysis section of said cell an electrolyte containing a fused salt of said metal to produce said metal, said electrolyte having a greater density than said metal;

causing said metal and additional said electrolyte to circulate continuously from said electrolysis section to said recovery section;

continuously separating said metal from said electrolyte in said recovery section;

causing said metal to circulate toward a part of said recovery section remote from said electrolysis section;

conveying said metal from said recovery section to said submerged reservoir; and periodically recovering said metal from said reservoir.

3. A process for the production of a molten metal by electrolysis in an electrolytic cell having an electrolysis section, a metal recovery section, a services section, a partition extending downwardly from a top of said cell between said services section and said electrolysis and recovery sections, and a submerged reservoir extending across at least a part of said recovery section and into said services section beneath said partition wall, said process comprising:

electrolysing at electrodes in said electrolysis section of said cell an electrolyte containing a fused salt of said metal to produce said metal, said salt having a greater density than said metal;

rapidly circulating said electrolyte upwardly through inter electrode spaces between said electrodes;

slowly circulating said electrolyte continuously from said electrolysis section toward a part of said recovery section spaced from said electrolysis section;

continuously separating said metal from said electrolyte at a part of said recovery section spaced from said electrolysis section;

conveying said metal from said recovery section to said submerged reservoir; and periodically recovering said metal from said reservoir through said services section.

4. An electrolytic cell comprising:

an electrolysis section;

a metal recovery section continuous with said electrolysis section;

a reservoir for storing a product metal said reservoir adapted for submersion in an electrolyte and having a top substantially closed to said electrolyte and a bottom substantially open to said electrolyte, when said reservoir is submersed; and means for conveying a product of electrolysis from said metal recovery section to said reservoir.

5. The cell of claim 4 comprising, in addition, a back and a front, and wherein said electrolysis section extends across said back and said recovery section extends across said front.

6. The cell of claim 5 wherein said electrolysis section includes a series of electrodes extending from said back into said electrolysis section, said electrodes comprising a series of anodes each having a maximum cross-section adjacent said back decreasing to a minimum cross-section at their forward extremities, and a series of cathodes facing said anodes.

7. The cell of claim 6 including bipolar electrodes between said anodes and said cathodes.

8. The cell of claim 6 wherein said anodes are wedge-shaped and wherein a broad end of said wedge shape is adjacent said back of said cell and a narrow end of said wedge shape projects forwardly into said cell.

9. The cell of claim 8 wherein anode leads are mounted through said back wall of said cell.

10. The call of claim 4 wherein said recovery section has a bottom wall extending from a lower part of said electrolysis section to a position at or near said front of said cell adjacent a surface of said electrolyte when said cell is in a normal operating condition.

11. The cell of claim 10 wherein an upper part of said bottom wall comprises a top wall of said reservoir.

12. The electrolytic cell of claim 4, said cell having a top and further comprising:

an electrolysis section;

a metal recovery section adjacent to and continuous with said electrolysis section;

a services section adjacent said recovery section and remote from said electrolysis section;

a partition wall extending downward from said top and separating said services section from said recovery section;

a reservoir in said metal recovery section for storing a product metal, said reservoir adapted for submersion in an electrolyte and extending below said partition wall into said services section;

means for conveying a product of electrolysis from said metal recovery section to said reservoir; and means extending through said services section into said reservoir for periodically extracting said product metal from said reservoir.

13. The cell of claim 12 wherein said cell has a back, front and sides, said electrolysis section extends transversely across said cell adjacent said back, said recovery section extends transversely across said cell adjacent said front, and said services section is in a front corner of said cell, defined by a part of a side and said front, and wherein said partition extends diagonally across said corner.

14. The cell of claim 12 wherein said services section is exterior to the area defined by a front, back and sides of said cell and wherein said partition comprises a part of a wall of said cell.

15. The cell of claim 12 including a heat exchanger in a lower part of said cell.

16. The cell of claim 15 wherein an inlet and an outlet for said heat exchanger are located in said services section.

17. The cell of claim 15 wherein said heat exchanger is removable from said cell through said services section.

18. The cell of claim 15 wherein said heat exchanger is of the heat pipe type.

19. The cell of claim 12 including a feeding port in said services section.

20. The cell of claim 12 including a second reservoir adapted for submersion in an electrolyte and having a compressed gas inlet and outlet in a top section of said reservoir for controlling electrolyte level in said cell.

21. The cell of claim 12 wherein a front side of said reservoir is adjacent a front side of said cell.

22. The cell of claim 12 wherein said means for conveying comprises a pump.

23. The cell of claim 22 wherein said pump is powered by flow of gas into and out of a pump body, said pump including a one-way valve allowing flow in a pump inlet line only on removal of gas from said body and including a second one-way valve allowing flow in a pump outlet line only on movement of gas into said pump body.

24. The cell of claim 12 wherein said means extending into said reservoir comprises one end of a syphon tube.

25. The cell of claim 12 wherein said means for periodically extracting comprises means for delivering said product metal to a pipeline loop, and wherein said cell further comprises means for electrically insulating said cell from said pipeline loop except during delivery of said product metal to said pipeline loop.

* * * * *